US005601039A

United States Patent [19]

Hyppänen

[11] Patent Number: 5,601,039

[45] Date of Patent: Feb. 11, 1997

[54] METHOD AND APPARATUS FOR PROVIDING A GAS SEAL IN A RETURN DUCT AND/OR CONTROLLING THE CIRCULATING MASS FLOW IN A CIRCULATING FLUIDIZED BED REACTOR

[75] Inventor: Timo Hyppänen, Karhula, Finland

[73] Assignee: Foster Wheeler Energia Oy, Helsinki, Finland

[21] Appl. No.: 331,605

[22] PCT Filed: May 18, 1993

[86] PCT No.: PCT/FI93/00208

§ 371 Date: Nov. 4, 1994

§ 102(e) Date: Nov. 4, 1994

[87] PCT Pub. No.: WO93/23703

PCT Pub. Date: Nov. 25, 1993

[30] Foreign Application Priority Data

May 21, 1992 [FI] Finland ..... 922319

[51] Int. Cl.[6] ..... F23G 5/00

[52] U.S. Cl. ..... 110/245; 122/4 D; 110/216; 55/444; 55/465

[58] Field of Search ..... 110/245, 216; 122/4 D; 55/444, 465

[56] References Cited

U.S. PATENT DOCUMENTS

| | | | |
|---|---|---|---|
| 2,221,073 | 11/1940 | Bubar | 55/444 |
| 4,359,968 | 11/1982 | Stewart | 122/4 D |
| 4,672,918 | 6/1987 | Engstrom et al. . | |
| 4,857,276 | 5/1989 | Seto et al. | 55/444 |
| 4,992,085 | 2/1991 | Belin et al. | 55/444 |
| 5,218,932 | 6/1993 | Abdulally | 122/4 D |
| 5,275,788 | 1/1994 | Stoholm . | |

*Primary Examiner*—Thomas E. Denion
*Attorney, Agent, or Firm*—Nixon & Vanderhye P.C.

[57] ABSTRACT

Method and apparatus for providing a gas seal in a CFB reactor, which is provided with a vertical, slot-shaped return duct (16), and for regulating the flow of circulating mass therein. The gas seal (22) is formed by arranging barrier means (22, 24, 26) on two different levels in the regulation zone of the return duct to slow down the flow of the circulating mass through the regulation zone. The flow of the circulating mass through the regulation zone is regulated by injecting fluidizing gas (56, 58, 60) into the regulation zone.

20 Claims, 4 Drawing Sheets

Figure 1:
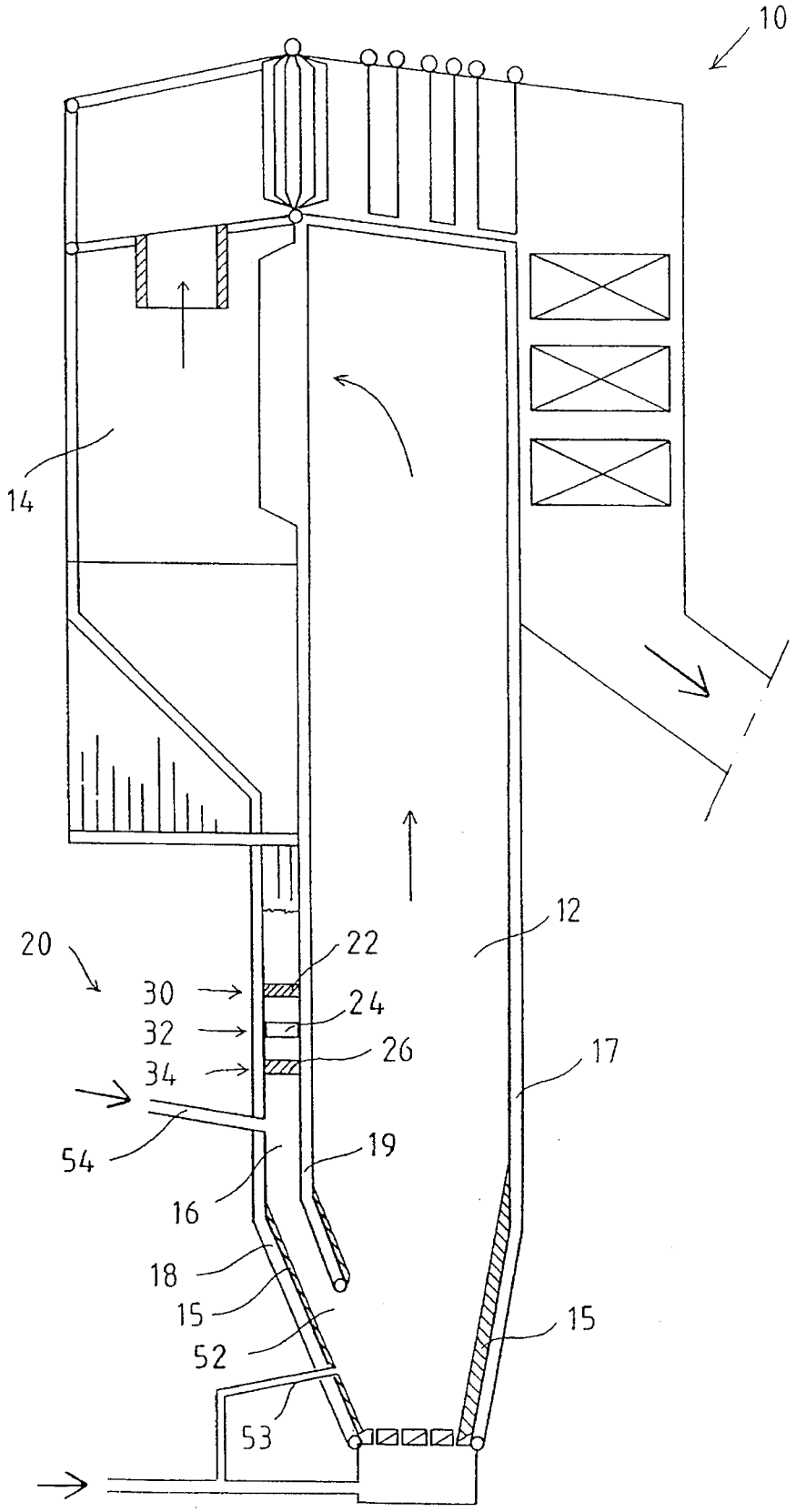

METHOD AND APPARATUS FOR PROVIDING A GAS SEAL IN A RETURN DUCT AND/OR CONTROLLING THE CIRCULATING MASS FLOW IN A CIRCULATING FLUIDIZED BED REACTOR

The present invention relates to a method and apparatus for providing a gas seal in a return duct and/or controlling the circulating mass flow in a circulating fluidized bed reactor, which is provided with a slot-shaped, vertical return duct defined by two, mainly vertical plane wall panels and ends joining these.

Circulating fluidized bed reactors are used, to an ever increasing extent, for combusting and gasifying various fuels, and as reactors in diverse chemical processes. They provide efficient mixing of gaseous and solid particles, which results in a uniform temperature of the process and faultless process control. In circulating fluidized bed reactors, the gas flow rate is maintained so high in the reaction or combustion chamber that a considerable portion of the bed material, entrained with the gases, flows out of the chamber. The major part of this solid material, i.e. the circulating mass, is separated from the gases in a particle separator connected with the chamber and is returned to the lower section of the combustion chamber via a return duct.

In circulating fluidized bed reactors such as PYROFLOW boilers, cyclone separators are used for separating circulating bed material from the gas. The circulating material is in this case returned via a return duct from the lower section of the cyclone to the lower section of the combustion chamber. The lower part of the return duct is provided with a member which serves as a gas seal preventing the gas from flowing via the return duct to the separator.

Fuel feed in the circulating fluidized bed reactors is often arranged in the return duct, where the fuel efficiently mixes with the circulating mass. The fuels generally contain some volatile substances which are separated from the solid fuel already in the return duct. Therefore, the fuel feed has to be arranged in the return duct below the loop seal so that these volatile substances are introduced into the combustion chamber thereby not causing any trouble, which would be the case if they flowed upwardly in the return duct.

Heat recovery from the circulating mass is awkward to arrange in a conventional loop seal construction. For regulating the circulating mass temperature in the return duct, the return duct is equipped with a separate heat exchanger, e.g., such as is provided with a fluidized bed. However, such an arrangement takes a lot of space, it is complicated and, naturally expensive.

In circulating fluidized bed boilers, heat is generally recovered by water walls of the combustion chamber and by heat transfer surfaces disposed in the upper section of the boiler. In some cases, however, it is desirable for the temperature regulation that heat could be recovered also from the circulating mass before returning the material from the particle separator to the lower section of the combustion chamber. In respect of optimum combustion, regulation of temperature is desirable in the combustion chamber, especially if several fuels having different heat values are combusted in the same combustion chamber. In order to achieve optimum sulphur absorption, the desired temperature of the combustion chamber is in the range of 800° to 950° C. In the earlier known methods, regulation of the combustion temperature is problematic, especially if the heat value of the fuel or the load of the boiler vary greatly.

Temperature regulation in the boilers of prior art is effected, for example, by changing the air excess in the combustion chamber, by recirculating flue gases to the combustion chamber, by altering the suspension density in the combustion chamber or by dividing the bed into various operational sections. Lowering of the combustion temperature by increasing the air excess lowers the boiler efficiency because the flue gas losses will increase and the power requirement of the air blower will grow. Recirculation of flue gases increases the volume of the gas flowing through the boiler, thereby growing the power requirement of the boiler and raising the investment and operating costs.

According to prior art, the temperature of the circulating fluidized bed boiler is regulated by cooling circulating mass or bed material in a separate, external heat exchanger. Various combinations of the gas seal and heat exchanger have been suggested for this purpose. For example, European patent application EP 0 449 522 discloses passing of the circulating mass from the particle separator via a duct to a separate heat exchanger which is provided with a fluidized bed and in which heat is recovered from the circulating mass. Circulating mass is passed from the heat exchanger as an overflow from its fluidized bed to the combustion chamber. Operation of an external fluidized bed reactor provided with separate cooling surfaces is, however, complicated and difficult to control. Furthermore, it brings extra investment and operating costs. The device calls for a considerable amount of fluidizing gas for fluidizing the heat transfer bed in a satisfactory manner in the heat exchanger. The fluidizing gas needed has to be pressurized which adds to the operating costs. Further, this extra fluidizing gas, the volume of which depends on the operation of the separate heat exchanger, has to be conducted to a suitable destination after fluidization, for example, to a combustion chamber for recovering the heat from the gas. Feeding of a varying amount of air to the process causes problems in the control of the combustion process itself, where the amounts of fluidizing and combustion air are the most important process parameters and should therefore not be amended for reasons other than those directly related to the combustion process. In circulating fluidized bed boilers, each specific load involves an optimum distribution between primary, secondary and potential tertiary air. The process control will suffer if this optimum air distribution has to be deviated from, for example, due to fluctuations in the amount of air coming from a separate heat exchanger.

Efforts have been made to simplify the structure of the circulating fluidized bed reactors and to make it such that part the structure could be manufactured from heat transfer surfaces, e.g., water tube panels. The development work has resulted in designs where the circulating material is separated from the gases in the separators which pass the separated material to a return duct being of the same width as the entire combustion chamber. Thus, also the return duct may be composed of heat transfer surfaces and be used for regulating the circulating mass temperature.

Finnish patent publication 85416 discloses a circulating fluidized bed reactor having a horizontal cyclone which is substantially of the same width as the reactor chamber and which serves as a particle separator. A plurality of adjacent return ducts separated from each other by a partition wall lead from the horizontal cyclone to the lower section of the reaction chamber. The return ducts are at least partly composed of water tube walls. At least part of the return ducts is provided with means for controlling the amount of solids flowing through the return duct. For example, the upper section of the return duct is provided with valves for closing the return duct partly or completely. The valves disposed in the upper section of the return duct are movable parts, and they are highly susceptible to wear in the hot suspension of particles, thus requiring frequent service.

In has also been suggested that the lower section of each return duct would be provided with an U-shaped fluidizing chamber operating as a gas seal. These gas seals prevent the flow of circulating mass from each return duct either partly or completely. If the circulating mass flow is adjusted to be different in various return ducts, this results in uneven return of circulating mass to different points of the lower section of the combustion chamber, which may be harmful in some cases. Temperature differences in adjacent return ducts may lead to uneven heat expansion in the structure, thereby causing damage. The temperature differences are especially awkward if the heat transfer surfaces of the return ducts are used as superheaters because their temperature changes in compliance with the mass flow. The actual reactor structure is simple and reliable, and its manufacture is inexpensive. The structure of gas seal is not expensive either. However, fuel cannot be fed into the return duct in this arrangement because the gas seal is in the lower section of the duct. If the fuel is introduced into the return duct, its volatile substances will cause gas flows in the return duct. Secondary air supply conduits to the combustion chamber wall on the return duct side have to be taken through both walls of the return duct, which makes the structure somewhat more complicated.

It is an object of the present invention to provide an improved method and apparatus in comparison with those described above for implementing the gas seal and/or controlling the circulating mass flow in a circulating fluidized bed reactor.

Especially, it is an object of the invention to provide a simple gas seal, which is preferably of a cooled structure.

It is also an object of the invention to enable an as optimal return of the circulating mass as possible to the lower section of the combustion chamber irrespective of the flow and temperature control effected in the return duct.

It is a characteristic feature of the method of the present invention for providing a gas seal and/or controlling the circulating mass flow in a circulating fluidized bed reactor, which is provided with a slot-shaped, vertical return duct, that the vertical flow of the circulating mass is controlled in the return duct within a regulation zone defined by barrier means disposed in the return duct, whereby barrier means are disposed horizontally on at least two levels having such distance h, between the levels, that flowing of circulating mass, caused by its flowing angle, is substantially prevented or slowed down in the regulation zone, and that the circulating mass flow is maintained or controlled in the regulation zone defined by the barrier means by supplying fluidizing or injection gas to the regulation zone.

It is a characteristic feature of the apparatus according to the invention that in the regulation zone of the return duct, on at least two horizontal levels, barrier means are disposed, which barrier means are of stationary construction and which barrier means slow down and/or prevent the circulating mass from flowing through the regulation zone, the barrier means are disposed horizontally on at least two levels having such distance h, between the levels that flowing of circulating mass, caused by flowing angle, is substantially prevented or slowed down in the regulation zone, and that nozzles or feed openings are further arranged in the regulation zone for supplying fluidizing gas or injection gas to the regulation zone.

Projections of the various barrier means preferably together cover the entire cross-sectional area of the return duct, whereby the barrier means prevent free vertical flow through the regulation zone.

The barrier means are essentially formed as a stationary construction being substantially non-movable. The barrier means of stationary construction may be made of horizontally disposed panels substantially in the shape of the cross section of the return duct. The panels are preferably attached at their edges to the return duct walls. The panels are provided with openings wherethrough the circulating mass finds its way and flows to the space below the panels. Openings in the various panels are preferably so disposed that they are not directly on top of each other on successive panels. When flowing through the regulation zone, the circulating mass therefore has to change its direction in such a manner that it flows at least partly horizontally from one opening to the other, which slows down or completely stops the circulating mass flow.

The barrier means may also be formed of small, e.g., masonry beams covering only a part of the return duct cross section. Such beams are disposed on the same horizontal plane successively and/or adjacently spaced from one another. Thus, openings are formed between the beams and need not be made in the beams themselves. The rows of beams on various levels are preferably disposed one on top of the other in such a manner that the spaces between the beams on two or more layers are not directly on top of one another. Thus, the circulating mass has to flow partly horizontally from between the row of beams on the upper level in between the row of beams on the lower level.

The barrier means may also simply be made of wall panels of the return duct by bending the wall or parts thereof towards the centre of the return duct in such a manner that a shoulder or a protrusion is formed in the return duct wall. Protrusions may be formed on both of the opposite walls, preferably on different levels. The protrusions on one level preferably cover over a half of the return duct cross section. In this manner, the total projection of two protrusions covers the entire cross section of the return duct. If the return duct walls are made of water tube panels, it is possible, e.g., to bend every other tube of the panel inwardly towards the centre of the return duct and combine the bent tubes by fins, which are broader than usually so as to form a gas-tight shoulder. The lower shoulders are preferably so shaped that their upper surface is at least partly horizontal.

Circulating mass accumulates on the upper surface of and between the barrier means, which are shaped as a panel, beam or shoulder as described above. Such accumulations form a pile or column of solids in the regulation zone. This column of solids forms a gas seal in the return duct, thereby preventing gas from flowing from the lower section of the combustion chamber upwards via the return duct further to the particle separator.

In the gas seal, the spaces between the barrier means on different levels, the spaces between the barrier means on the same level or the openings in the barrier means partly define the height of the solids column composed of circulating mass in the gas seal and they also define the pressure difference over the gas seal.

Flowing of the circulating mass through the regulation zone or the solids column forming the gas seal is adjusted by causing the solids to flow in a controlled manner past the barrier means so that a small amount of fluidizing gas or injection gas is injected to suitable places in the regulation zone. The gas causes the solids to flow past the barrier means to the lower section of the return duct and further to the combustion chamber. By adjusting the gas feed it is possible to control the flow of the circulating mass through the regulation zone. In this way, the amount of material flowing through the return duct and the cooling of the material in the return duct are controllable.

The fluidizing air or injection air in the gas seal may also be used for directing the circulating mass so that the circulating mass flows past the barrier means in the desired direction, whereby the gas seal serves as a three-way valve. It is possible to direct the circulating mass flow downwards from the gas seal towards the lower section of the return duct or sideways towards the opening which is formed in the wall common to the return duct and the combustion chamber and through which circulating mass is fed to the upper section of the combustion chamber.

In a circulating fluidized bed reactor according to the invention, the amount of circulating mass may be adjusted in the combustion chamber by leading a bigger or a smaller portion of the circulating mass to the return duct, i.e., by adjusting the level of the solids column in the return duct. When the amount of circulating mass is to be reduced in the combustion chamber or when the level of the solids column in the return duct is below the set value, the volume of fluidizing air or blast air is momentarily reduced in the regulation zone formed by the barrier means and the level of the solids column is thereby raised. A decrease in fluidization slows down the flow of solids past the barrier means, and a larger amount of circulating mass coming from the particle separator is accumulated in the return duct. Correspondingly, if the amount of circulating mass is to be increased in the combustion chamber or if the level of the solids column exceeds the set value, the amount of fluidizing air in the space between the barrier means is increased, whereby the circulating mass flows at a higher velocity in the return duct, and the level of the solids column lowers.

Thus, by adjusting the fluidizing air or blast air in the regulation zone of the return duct, it is possible to adjust the amount of solids in the combustion chamber. Solids may be stored in the return duct, if desired. Thereby the amount of solids in the combustion chamber is controllable. For example, in order to deduct the heat transfer coefficients of the combustion chamber, the total amount of solids may be temporarily decreased by storing a portion of the solids or circulating mass in the return duct.

Level adjustment of the solids column in the return duct of the circulating fluidized bed reactor may also be used for adjusting the heat transfer capacity of the heat exchangers above the regulation zone. The heat transfer coefficient of the heat exchanger within the solids column is bigger than the heat transfer coefficient of the heat exchanger above the level of the solids column. Heat recovery from the solids may thus be increased by raising the level of the solids column or decreased by lowering the level of the solids column so that an ever increasing or an ever decreasing part of the heat exchanger remains within the solids column. In this manner, cooling of the circulating mass may be made more or less efficient and the temperature of the combustion chamber itself be controlled.

In the arrangement according to the invention, it is also possible to have the gas seal on a high level in the return duct, whereby the temperature of the circulating mass may be regulated by controlling the circulating mass flow and by utilizing also the heat transfer surfaces below the gas seal, e.g., water walls of the return duct.

When the gas seal is arranged on a high level in the return duct, this also brings the advantage of the gas seal functioning at a lower pressure difference or a solids column than it would if arranged on a lower level in the return duct. The reason for this is that the pressure prevailing in the upper section of the combustion chamber is lower. When the solids column is lower, it is easier to maintain the operation of the process steady in the combustion chamber.

The method and the apparatus according to the invention also enable the flow to be totally stopped to any section of the combustion chamber by stopping the fluidizing air flow in the regulation zone so that the circulating mass is prevented from flowing vertically or sideways at a corresponding point in the return duct. In this manner, e.g., the heat contained in the solids flow may be distributed to various parts of the process in accordance with the goals set by the process control.

The method and the apparatus according to the invention also make the corrosion risks of the superheaters smaller in the circulating fluidized bed boilers, where fuels containing corrosive substances are combusted. Generally, corrosion constitutes a problem in the hottest superheaters in combustion of fuels which contain corrosive substances such as chlorine. The hot superheater surfaces disposed in the upper section of the boiler are, due to the composition of the flue gases, highly susceptible to corrosion. In the circulating fluidized bed boiler of the invention, the hottest superheaters may be disposed within the circulating mass in the return duct, where only a very small amount of harmful flue gases or no harmful flue gases at all have access. The adjustment according to the invention enables maintenance of the solids column of a desired height in the return duct. The fluidizing gas supplied to the return duct also efficiently dilutes the harmful gases possibly coming from the combustion chamber, whereby the composition of the gas in the return duct is different, i.e., considerably less corroding than the composition of the gas in the combustion chamber. Thus, in accordance with the invention, the corrosion risk of the superheaters may be avoided or at least remarkably decreased.

Figure 2:
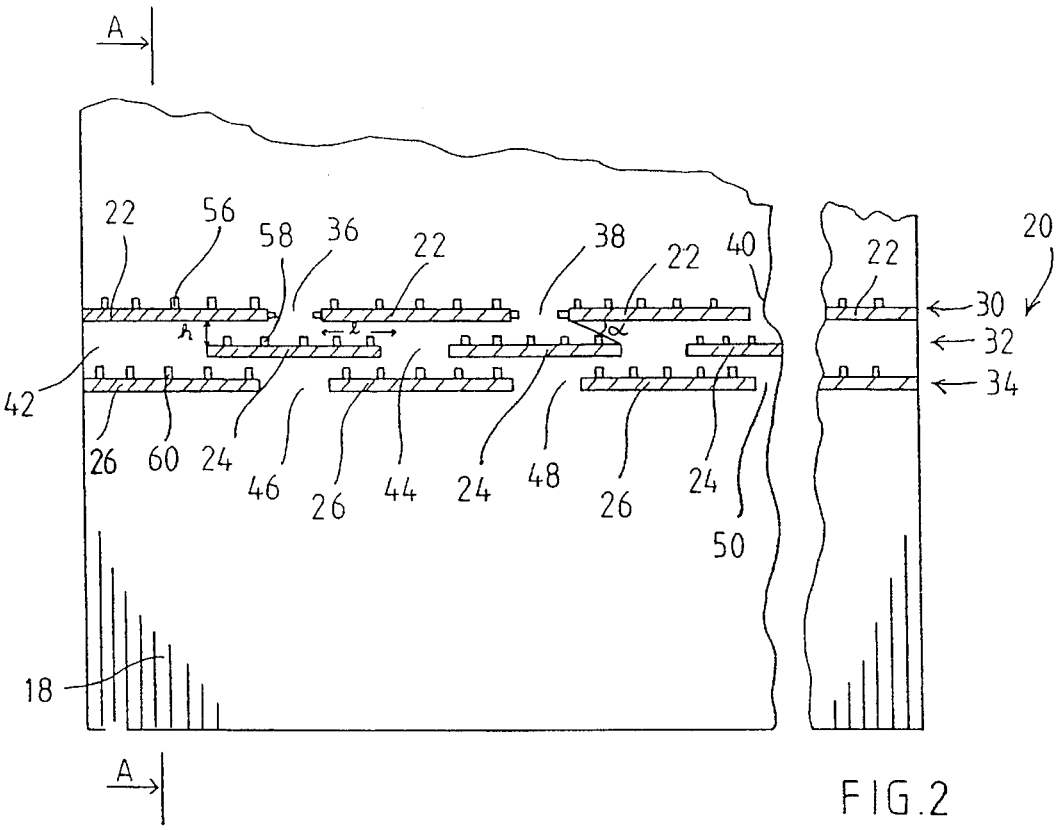
Figure 3:
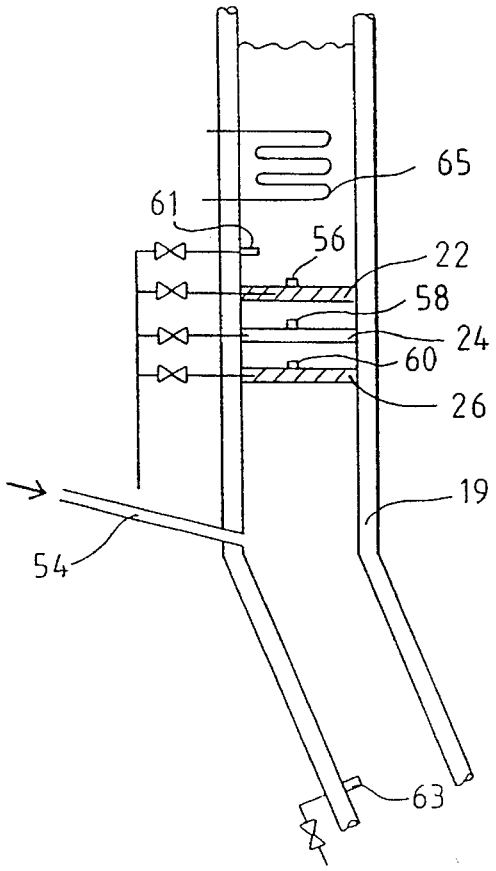
Figure 4:
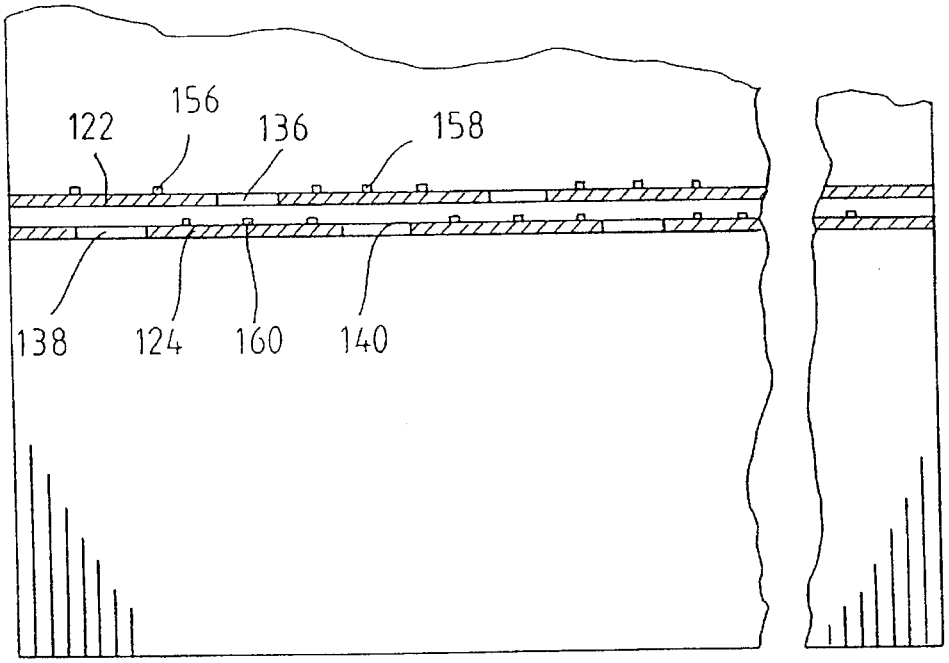
Figure 5:
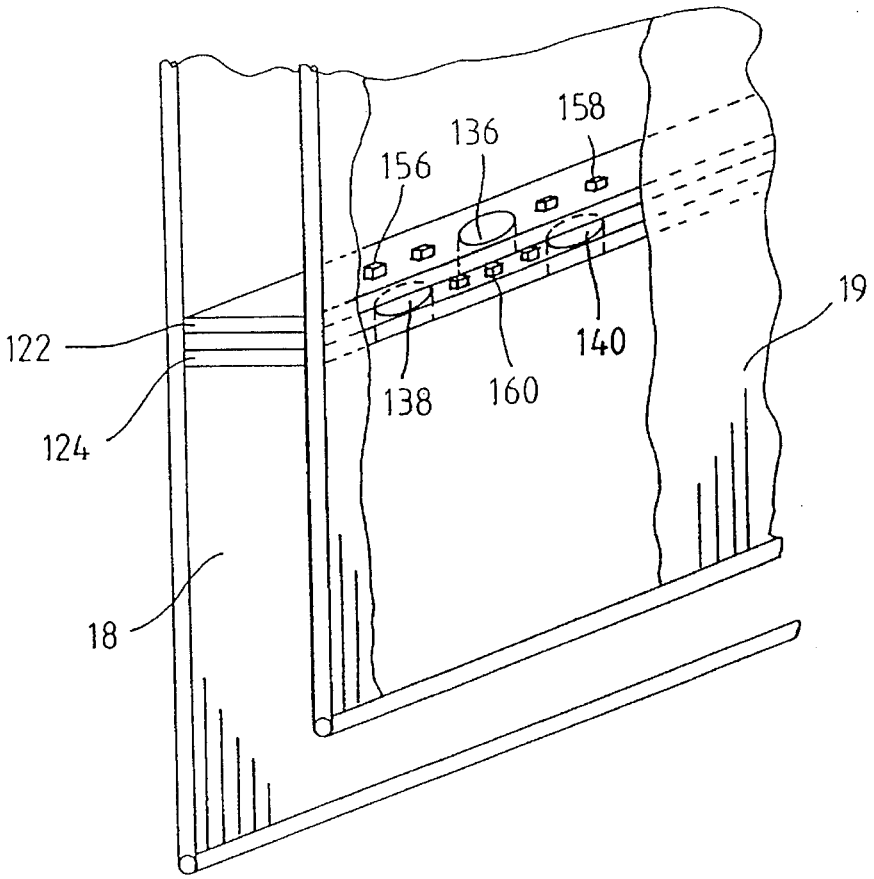
Figure 6:
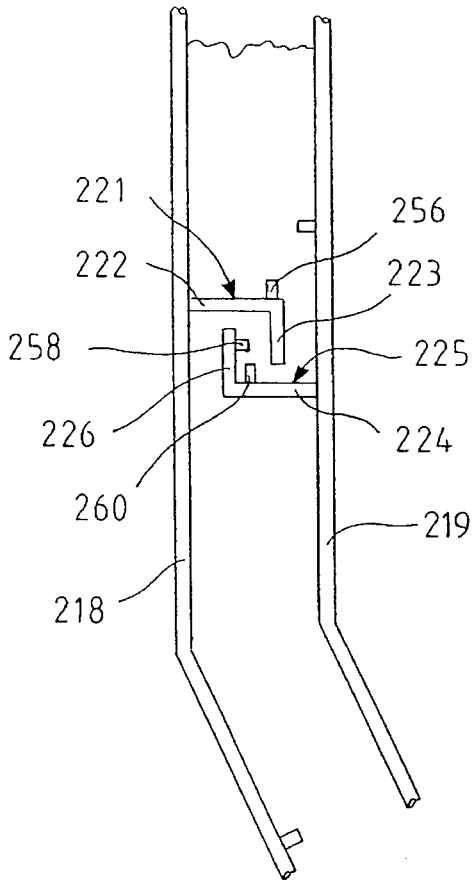
Figure 7:
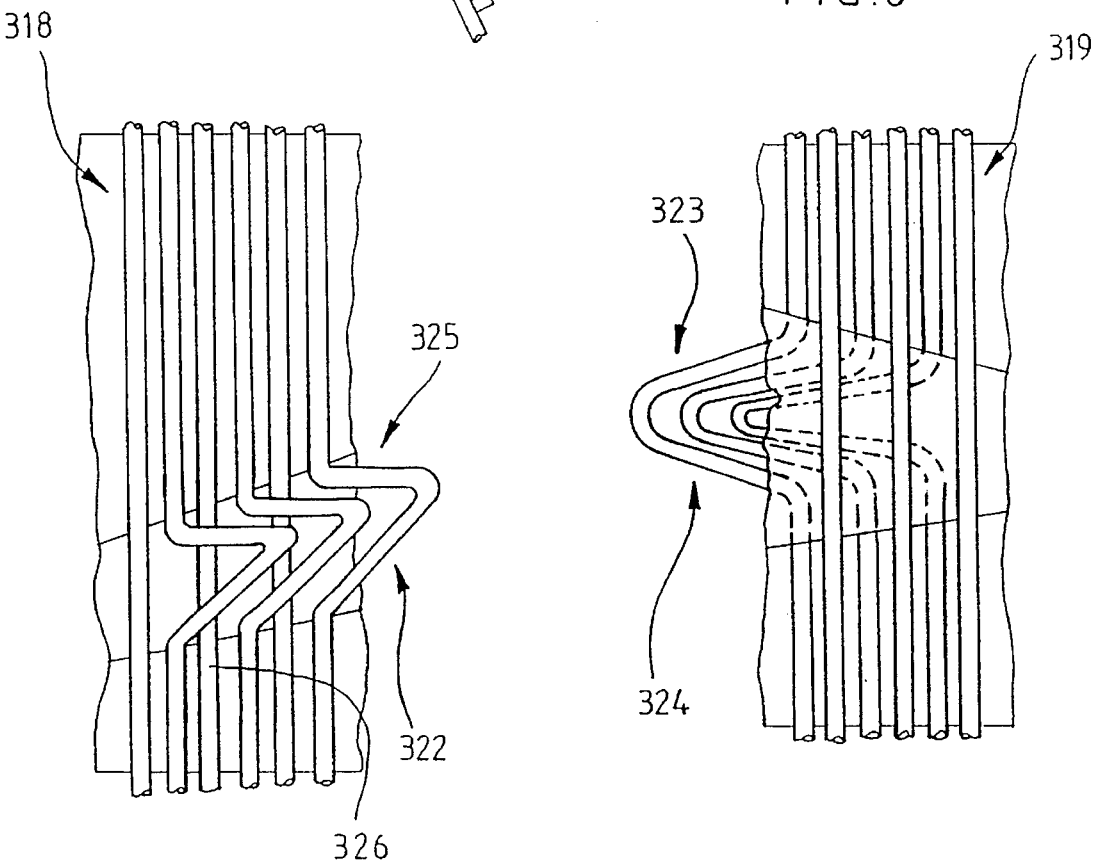

The invention will be described more in detail in the following, by way of example, with reference to the accompanying drawings, in which FIG. 1 is a vertical sectional view of a circulating fluidized bed reactor, where the control method of the invention is applied, FIG. 2 is a vertical sectional view, in the direction of the combustion chamber wall, of a regulation zone in the return duct in accordance with the invention, FIG. 3 is a cross-sectional view of FIG. 2 taken along line A—A, FIG. 4 is a vertical sectional view, in the direction of the combustion chamber wall, of a second regulation zone in the return duct, FIG. 5 illustrates a perspective, partial section of FIG. 4, FIG. 6 is a vertical cross-sectional view of a third regulation zone in accordance with the invention, and FIG. 7 illustrates a perspective, partial section of a fourth regulation zone in the return duct, in accordance with the invention.

FIG. 1 illustrates a circulating fluidized bed reactor 10, which is applicable to, e.g., combustion of coal or biological fuel and in which the method of controlling the circulating mass flow in accordance with the invention is applied. Reactor 10 comprises a combustion chamber 12, a particle separator 14 for separating circulating material from the flue gases discharged from the upper section of the combustion chamber, and a return duct 16 for returning the separated circulating material to the lower section of the combustion chamber. The combustion chamber, particle separator and return duct are at least partly composed of tube walls 17, 18 and 19. In the lower section of the combustion chamber, the tube walls are protected against erosion by a protective layer 15.

In about the middle of the return duct, a vertical regulation zone or a gas seal 20 for the circulating mass flow is arranged. This regulation zone or gas seal controls the vertical flow rate of the circulating mass in the return duct and prevents the gases from recirculating from the combustion chamber via the return duct to the separator. The regulation zone is defined by barrier means 22, 24, 26 disposed in the return duct. Some of them are shown in FIGS. 1, 2 and 3.

The barrier means may be formed of, e.g., masonry pieces, substantially equal in width with the slot-shaped return duct. A plurality of barrier means 22 are disposed on the same horizontal level successively in rows 30, 32 and 34 as shown in FIG. 2. The barrier means in row 30 are disposed at a small distance from each other so that openings 36, 38, 40 are formed between them. The circulating mass flows through these openings from the level of row 30 to the level of row 32 below and towards the barrier means 24. The openings 36, 38, 40 are preferably shorter than a half of the length of the barrier means 32.

The barrier means 24 are also preferably disposed successively in a row at a distance equalling the size of openings 42, 44 from each other. The barrier means of rows 30 and 32 are so disposed that directly below the openings 36, 38, 40 in row 30 is disposed a barrier 24, which prevents the circulating mass from flowing freely downwards, but directs it sideways. The circulating mass flows horizontally between the rows 30 and 32 of barrier means until it reaches the openings of row 32, wherethrough it is capable of flowing down to the next level.

Correspondingly, the barrier means 26 in the row 34 below the row 32 are so disposed in regard to the barrier means 24 in the row 32 so that the circulating mass flow has to change its direction again when reaching the barrier means of rows 34. From the row 34, the circulating mass flows via openings 46, 48, 50 out of the regulation zone and freely to the lower section of the return duct and further via opening 52 to the lower section of the combustion chamber. In the example shown in the FIG. 1, the gas seal is disposed relatively high in the return duct. The inner wall 19 of the return duct does not extend to the lowest section of the combustion chamber, but the opening 52 from the return duct to the combustion chamber remains at a distance from the bottom of the combustion chamber. Thus, the supply of secondary air 53 need not be taken through the return duct 16 and two walls 18 and 19, but only through wall 18. When the gas seal 20 is disposed on a relatively high level in the return duct, it is easy to fit the fuel feed means 54 into the return duct.

The barrier means are arranged in rows 30, 32 and 34 so that the barrier means 22 and 24 are partly on top of each other. The barrier means are disposed for the length 1 on top of each other and the rows 30 and 32 at a distance h from each other. The optimum ratio of length 1 to distance h is $h=\frac{1}{2}\times 1$. This optimum ratio is dependent on the circulating material. The ratio of length 1 to distance h can be illustrated with angle $\alpha$ as in FIG. 2. Generally speaking, the barrier means are preferably so disposed that angle $\alpha$ is smaller than the flow angle of solids, whereby the natural flow of solids through the regulation zone is limited or totally prevented.

The barrier means are preferably so disposed in the return duct that the circulating mass accumulating on the barrier means does not by itself flow down to the level below. The circulating mass accumulating on the barrier means 24 and 26 forms a gas seal in the regulation zone, preventing the gas flow from the lower section of the return duct to the upper section thereof. Thus, it is possible to control the circulating mass flow through the regulation zone by means of fluidizing airs adjusted to the regulation zone.

By arranging feed of fluidizing or injection air/gas via nozzles 56, 58, 60 to the regulation zone, as shown in FIG. 3, it is possible to make the circulating mass accumulated on the barrier means move and flow in a controlled manner downwardly via openings 36, 38, 40, 42, 44, 46, 48, 50. By suitably adjusting the air supply, a circulating mass layer forming the gas seal is maintained in the regulation zone.

Air nozzles 56, 58, 60 may be fitted into the barrier means. Air nozzles 61, 63 may also be fitted into the return duct walls. The air nozzles 56, 58, 60, 61 are so disposed that they provide suitable fluidization in the circulating mass on top of and between the barrier means. This fluidization enables material flow through the regulation zone. The air nozzle 63 leads circulating mass from the lower section of the return duct to the lower section of the combustion chamber. The air nozzle is mainly used for controlling the amount of solids in the return duct and thus also the level of the solids flow.

The barrier means disposed in the return duct may be cooled. Cooling may be arranged, e.g., by disposing cooling pipes so that they run through the barrier means. The return duct may also be provided with a separate heat transfer surface 65, e.g., a superheater surface. Thus, the air nozzle 61 may be used for influencing the fluidization of solids in the superheater zone and further the heat transfer of the superheater.

FIGS. 4 and 5 illustrate a control arrangement according to the invention, in which arrangement the regulation zone of the return duct is provided with barrier means 122 and 124 formed of panels made of flat plate material substantially in the shape and size of the return duct cross section. The barrier means are provided with openings 136, 138, 140, wherethrough the circulating mass flows through the regulation zone. Air nozzles 156, 158, 160 are disposed in connection with the openings and below them in order to provide the desired flow of the circulating mass. The panels made of flat plate material may be cooled. The panels disposed on different levels of the regulation zone may be completely separate pieces or they may be formed of a single panel bent two-fold or three-fold.

FIG. 6 illustrates another manner of making barrier means formed of flat plate material in the regulation zone. The panels 222 and 224 are attached at only one edge thereof to the return duct wall. One side 221 of panel 222 is attached to the outer wall 218 of the return duct and the other side 223 is bent downwardly towards panel 224. One side 225 of panel 224 is attached to the inner wall 219 of the return duct and the other side 226 is bent upwardly towards panel 222. In this manner, a labyrinth flow channel is formed between the panels and circulating mass is accumulated therein. The flow of circulating mass is maintained at the desired rate in the regulation zone by means of air nozzles 256, 258 and 260 disposed in the panels. The circulating mass first flows downwardly along the wall 219 towards the panel 224, wherefrom the air nozzles 258 and 260 fluidize the circulating mass upwardly towards the panel 222 and therefrom further downwardly along wall 218. The panels 222 and 224 may be comprised of cooled water tube panels formed of tubes 217.

FIG. 7 illustrates an arrangement where the barrier means 322 and 324 are formed of cooling tube panels, water, evaporation or superheating tube panels, which form the walls 318 and 319 of the return duct. For example, every other tube of the panel is bent towards the centre of the return duct so that the bent tubes form a shoulder or a stud 322, 324 in the return duct wall. A shoulder is created on both walls, and one of the shoulders is higher up than the other so that their total horizontal projection covers the entire cross section of the return duct. The bent water tubes are combined with broad fins 326 so that the protrusion will be gas-tight. The protrusions bring about a labyrinth flow of the circulating mass. The more circulating mass accumulates on the protrusions the more horizontal the upper surface 323 and 325 of the protrusion is. Air nozzles may be disposed, for example, in fins 326 in the upper surface of the lowermost protrusion and at the end of the stud or upper protrusion protruding towards the return duct. The ducts may be shielded against erosion by protective lining. To make the illustration more distinct, in FIG. 7, the walls 318 and 319 have been drawn at a distance from each other.

It is not an intention to limit the invention within the examples described above, but it can be applied within the scope defined in the appended claims.

I claim:

1. A method of operating a circulating fluidized reactor, which reactor has a slot-shaped vertical return duct defined by two substantially vertical plane wall panels, with ends joining the wall panels; said method comprising the steps of:

(a) defining a regulation zone in the return duct utilizing substantially horizontally disposed barriers in the return duct, provided at at least two different vertical levels in the return duct, so that circulating particles of the circulating fluidized bed reactor are prevented from freely circulating through the regulation zone; and (b) effecting circulation of the particles in the regulation zone defined by the barriers by supplying gas to the regulation zone, and to form a solids column in the regulation zone between the substantially horizontally disposed barriers, the solid column forming a gas seal between the barriers.

2. A method as recited in claim 1 wherein step (b) is practiced by supplying fluidizing gas to the regulation zone via nozzles or feed openings disposed in an upper section of the lower one of the barriers.

3. A method as recited in claim 1 wherein step (b) is practiced by supplying fluidizing gas to the regulation zone via nozzles or feed openings disposed in an upper barrier of the barriers.

4. A method as recited in claim 1 wherein heat transfer surfaces are provided for cooperation with the circulating particles to receive heat energy from the circulating particles, the heat transfer surfaces provided in the return duct; and wherein step (b) is practiced to control the vertical flow of circulating particles through the regulation zone to thereby in turn control the rate of heat transfer from the circulating material to the heat transfer surfaces of the return duct.

5. A method as recited in claim 4 comprising the further step of cooling the barriers.

6. A method as recited in claim 1 wherein steps (a) and (b) are practiced so that the entire circulating mass of circulating particles of the circulating fluidized bed reactor ultimately flows through the regulation zone.

7. A method as recited in claim 1 wherein the circulating particles flow by gravity downwardly through the return duct.

8. A method as recited in claim 1 comprising the further step of feeding fuel to the return duct below the regulation zone.

9. Apparatus for controlling a circulating fluidized bed reactor, having circulating particles with a predetermined flow angle, comprising:

a circulating fluidized bed reactor including a reactor zone, a particle separator, and a slot-shaped return duct defined by primarily vertical plane wall panels with ends joining the wall panels, the return duct returning the circulating particles separated by the separator to the reactor zone;

a regulation zone in the return duct defined by at least two generally horizontal stationary barriers having vertically non-aligned openings therein, the barriers vertically spaced a distance, and the opening horizontally spaced a distance, so that an angle $\alpha$ is defined between a lower barrier opening and an immediately adjacent upper barrier opening, the angle $\alpha$ being less than the circulating particles flow angle so that a gas seal is formed between the barriers; and means for supplying gas to the regulation zone to control the rate of flow of the circulating particles through the regulation zone.

10. Apparatus as recited in claim 9 wherein the barriers, collectively, horizontally cover the entire cross-sectional area of the return duct so that free vertical flow of circulating particles through the regulation zone is prevented.

11. Apparatus as recited in claim 10 wherein said barriers comprise at least two plane panels each provided with a plurality of openings therein, and the openings in said panels being non-alinged with an immediately adjacent panel.

12. Apparatus as recited in claim 11 wherein said barrier panels are cooled.

13. Apparatus as recited in claim 11 wherein a lower of said panels includes fluidizing gas nozzles below the openings in an upper of said panels.

14. Apparatus as recited in claim 9 wherein said barriers are formed in the walls of said return duct by bending a plane wall panel inwardly so as to provide a shoulder or protrusion, an opening being provided at the beginning and end of a protrusion.

15. Apparatus as recited in claim 14 wherein at least one of said plane wall panels is of a water tube construction; and wherein said barrier is formed by bending every other water tube of said water tube construction inwardly into said return duct.

16. Apparatus as recited in claim 10 wherein said barriers are formed of masonry beams which are positioned with respect to each other so as to define said openings and to prevent free vertical flow of circulating particles through the return duct.

17. Apparatus as recited in claim 16 wherein said means for supplying gas to said regulation zone comprises fluidizing gas nozzles disposed in said masonry beams.

18. Apparatus as recited in claim 10 wherein said at least two generally horizontal stationary barriers comprise at least three barriers including an upper, middle, and lower barriers, said middle barrier having an opening vertically non-aligned with said upper and lower barrier openings.

19. Apparatus as recited in claim 9 wherein said barriers are vertically opened a distance h, and said immediately adjacent openings therein are horizontally spaced a distance l, and wherein h=½.

20. Apparatus for controlling a circulating fluidized bed reactor comprising:

a circulating fluidized bed reactor including a reactor zone, a particle separator, and a slot-shaped return duct defined by primarily vertical plane wall panels with ends joining the wall panels, the return duct returning particles separated by the separator to the reactor zone;

at least two generally horizontal stationary barriers extending between said primarily vertical plane wall panels in said return duct and having vertically non-aligned openings therein, said barriers vertically spaced a distance h, and immediately adjacent openings in said barriers being spaced a distance l, wherein h=½l; and means for supplying gas to, above, or below at least one of said barriers to control the rate of flow of circulating particles through said barrier openings.

* * * * *